US006021732A

United States Patent [19]

Hobbs

[11] Patent Number: 6,021,732

[45] Date of Patent: Feb. 8, 2000

[54] HULL AND METHOD OF FABRICATING A HULL

[76] Inventor: Herbert J. Hobbs, 722 Galveston La., Key West, Fla. 33041

[21] Appl. No.: 09/033,244

[22] Filed: Mar. 3, 1998

Related U.S. Application Data

[60] Provisional application No. 60/040,204, Mar. 6, 1997.

[51] Int. Cl.[7] ..... B63B 5/24

[52] U.S. Cl. ..... 114/357; 264/219

[58] Field of Search ..... 114/355, 357, 114/359; 264/571, 34, 219

[56] References Cited

U.S. PATENT DOCUMENTS

| | | | |
|---|---|---|---|
| 1,168,828 | 1/1916 | Schmitt . | |
| 3,372,408 | 3/1968 | Luger et al. | 114/355 |
| 3,806,971 | 4/1974 | Elling . | |
| 4,471,710 | 9/1984 | Brown | 114/357 |
| 5,517,934 | 5/1996 | Brown | 114/357 |
| 5,526,767 | 6/1996 | McGuiness et al. | 114/357 |

FOREIGN PATENT DOCUMENTS

| | | |
|---|---|---|
| 148905 | 4/1966 | France . |
| 527333 | 6/1977 | U.S.S.R. . |
| 1062152 | 3/1967 | United Kingdom . |

*Primary Examiner*—Jesus D. Sotelo
*Attorney, Agent, or Firm*—St. Onge Steward Johnston & Reens LLC

[57] ABSTRACT

A method of fabricating boat hulls is provided. A first piece of molding material is contoured on a concave mold in a particular position dependent on predetermined desired hull parameters to form a first hull half panel. The concave mold has a compound surface, which constitutes a portion of the surface of a torus having a constant radius and an elliptical cross-section. The first piece of molding material is allowed to set and is then removed from the concave mold. A second piece of molding material is contoured on the concave mold in substantially the reverse profile of the first piece of molding material to form a second hull half panel, the second hull half panel being a substantially mirrored image of the first hull half panel. The second piece of molding material is allowed to set and is removed from the concave mold. The first hull half panel and the second hull half panel are then bonded together to form a boat hull. The above steps can then be repeated to produce numerous boat hulls having any number of varying hull parameters from the same concave mold.

10 Claims, 4 Drawing Sheets

HULL AND METHOD OF FABRICATING A HULL

BENEFIT CLAIMED

This application claims the benefit of copending provisional application number 60/040,204, filed Mar. 6, 1997.

FIELD OF THE INVENTION

The present invention relates to molded panels for use in constructing a boat, and more particularly to a boat hull fabricated from molded panels and a method for molding such panels.

BACKGROUND OF THE INVENTION

Constructing aircraft, boats, and the like from a number of pre-formed molded panels is well known. However, it is also well known that forming panels curved along both the major and minor axes (i.e., compound and complex surfaces) is extremely difficult. Traditionally, forming such panels had been accomplished by "cold molding," which entailed fitting together a plurality of small, flat wooden strips to form the larger compound or complex surface. The necessary close fit between the strips was achieved by hand carving the edges of each strip, a process which was labor intensive and, therefore, extremely expensive. A further problem associated with cold molding involved bi-lateral structures, for example the starboard and port halves of a two-piece hull. Since the two pieces are mirror images of each other, separate mold jigs or frames were necessary, thus further increasing the production costs of a boat constructed of cold-molded panels.

A significant improvement upon cold-molding techniques was the constant camber veneer molding process disclosed in U.S. Pat. No. 4,471,710 to Brown ("the '710 patent"). According to this design, a convex, or male, compound mold is provided, upon which a plurality of geometrically identical strips of building material are temporarily fastened with tacks, nails, staples, or the like, and adhered together. A second layer of strips may then be adhered to the first layer, if desired. When the adhesive has set, the panel is removed from the mold.

Although the molding process disclosed in the '710 patent rectified many of the problems associated with cold-molding, several deficiencies still exist. A first disadvantage involves veneer molding itself. Do to the nature of the molding process, shapes having a tight radius cannot easily be produced even though often desirable. Another disadvantage of the prior art patent is that when each panel is complete, the outer surface is not finished. Extensive fairing is thus required before the surface may be painted, a process which requires large amounts of both time and effort.

Another problem with the panels disclosed in the '710 patent is that in order to form a hull having varying parameters (i.e., fineness in the bow, fullness in the center and aft, etc.), contorting, or "torturing," of the panels is necessary. This torturing leads to several disadvantages. First, the process of torturing the hull panels while attempting to bond them together is difficult and may prove unreliable. For example, the two hulls of a catamaran may not be identical if each hull is not contorted precisely. Moreover, if torturing is necessary, the hull panels cannot be molded from very stiff materials. Thus, extra supporting structure is required for hull stability. In addition, when the panels are to be tortured, modeling of the finished hull is nearly impossible, since torturing the miniature version of the panels to create the model hull will rarely yield the same shape as will torturing the panels to create the full sized boat hull.

What is desired, therefore, is a method for producing molded panels for fabricating boat hulls by which shapes having a tight radius can be produced, by which the panels have finished and fair outer surfaces, by which torturing of the panels is not necessary to fabricate hulls having varying parameters, by which panels can be produced from very stiff materials, and by which accurate models of the finished boat hull can be easily created.

SUMMARY OF THE INVENTION

Accordingly, it is an object of the present invention to provide a method for producing molded panels for fabricating boat hulls by which shapes having a tight radius can be produced.

Another object of the present invention is to provide a method for producing molded panels for fabricating boat hulls by which the panels have finished and fair outer surfaces.

A further object of the present invention is to provide a method for producing molded panels for fabricating boat hulls by which torturing of the panels is not necessary to fabricate hulls having varying parameters.

Still another object of the present invention is to provide a method for producing molded panels for fabricating boat hulls by which panels can be produced from very stiff materials.

Yet a further object of the present invention is to provide a method for producing molded panels for fabricating boat hulls by which accurate models of the finished boat hull can be easily created.

These and other objects of the present invention are achieved by provision of a method for fabricating boats hulls, wherein a concave mold having a compound surface is provided. The compound surface constitutes a portion of the surface of a torus having a constant radius and an elliptical cross-section. A first piece of molding material is contoured on the concave mold in a particular position dependent on predetermined desired hull parameters to form a first hull half panel. The first piece of molding material is allowed to set and is then removed from the concave mold. A second piece of molding material is contoured on the concave mold in substantially the reverse profile of the first piece of molding material to form a second hull half panel, the second hull half panel being a substantially mirrored image of the first hull half panel. The second piece of molding material is allowed to set and is removed from the concave mold. The first hull half panel and the second hull half panel are then bonded together to form a boat hull. The above steps can then be repeated to produce numerous boat hulls having any number of varying hull parameters from the same concave mold.

The invention and its particular features and advantages will become more apparent from the following detailed description considered with reference to the accompanying drawings.

DETAILED DESCRIPTION OF THE INVENTION

Figures 1, 2:
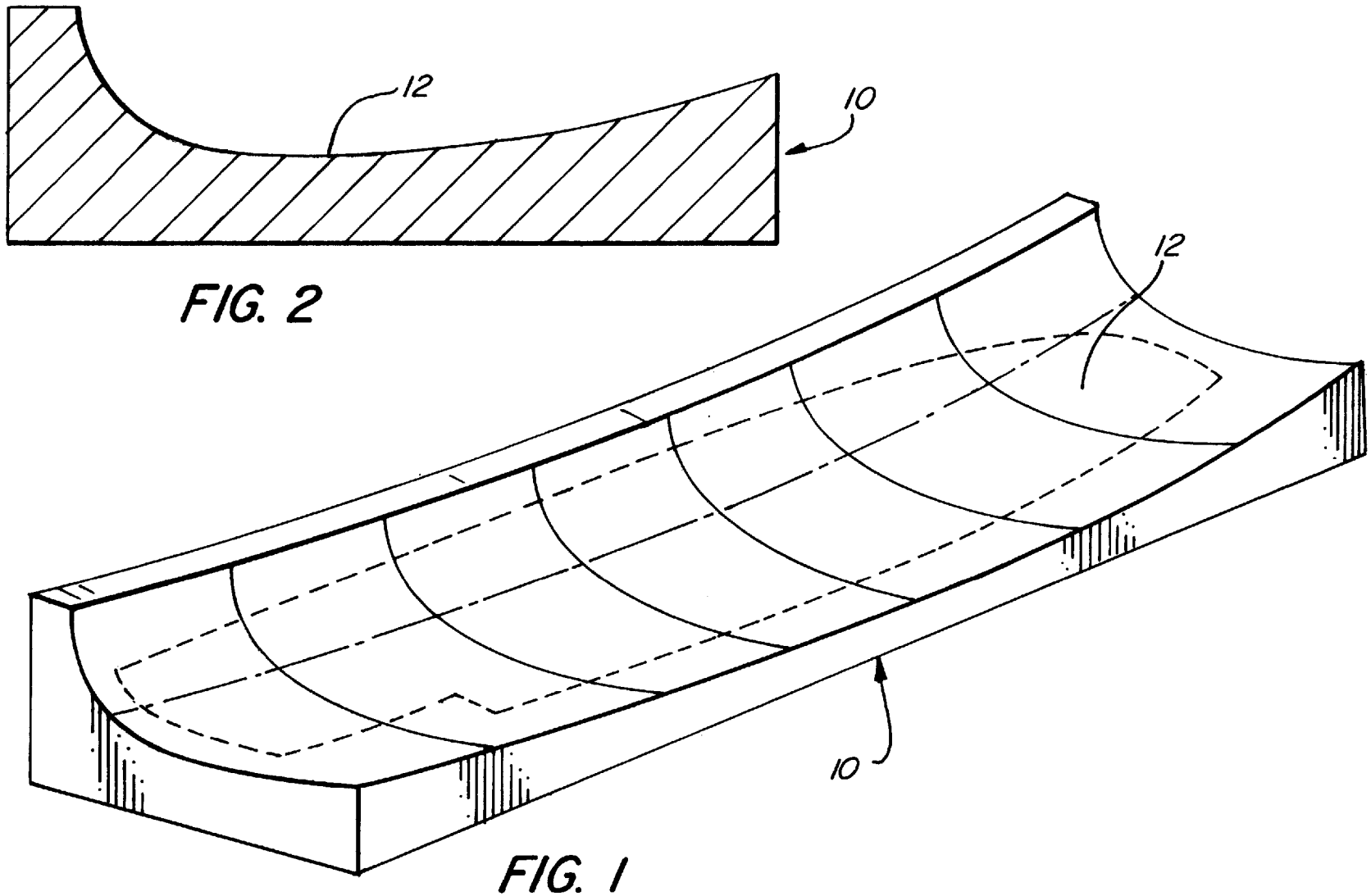
FIG. 1 is a side isometric view of a concave mold for use with the method of fabricating boat hulls in accordance with the present invention, with a hull half panel contoured on the molding surface of the concave mold shown in phantom.
FIG. 2 is a cross-sectional view of the concave mold of FIG. 1.
Figure 3:
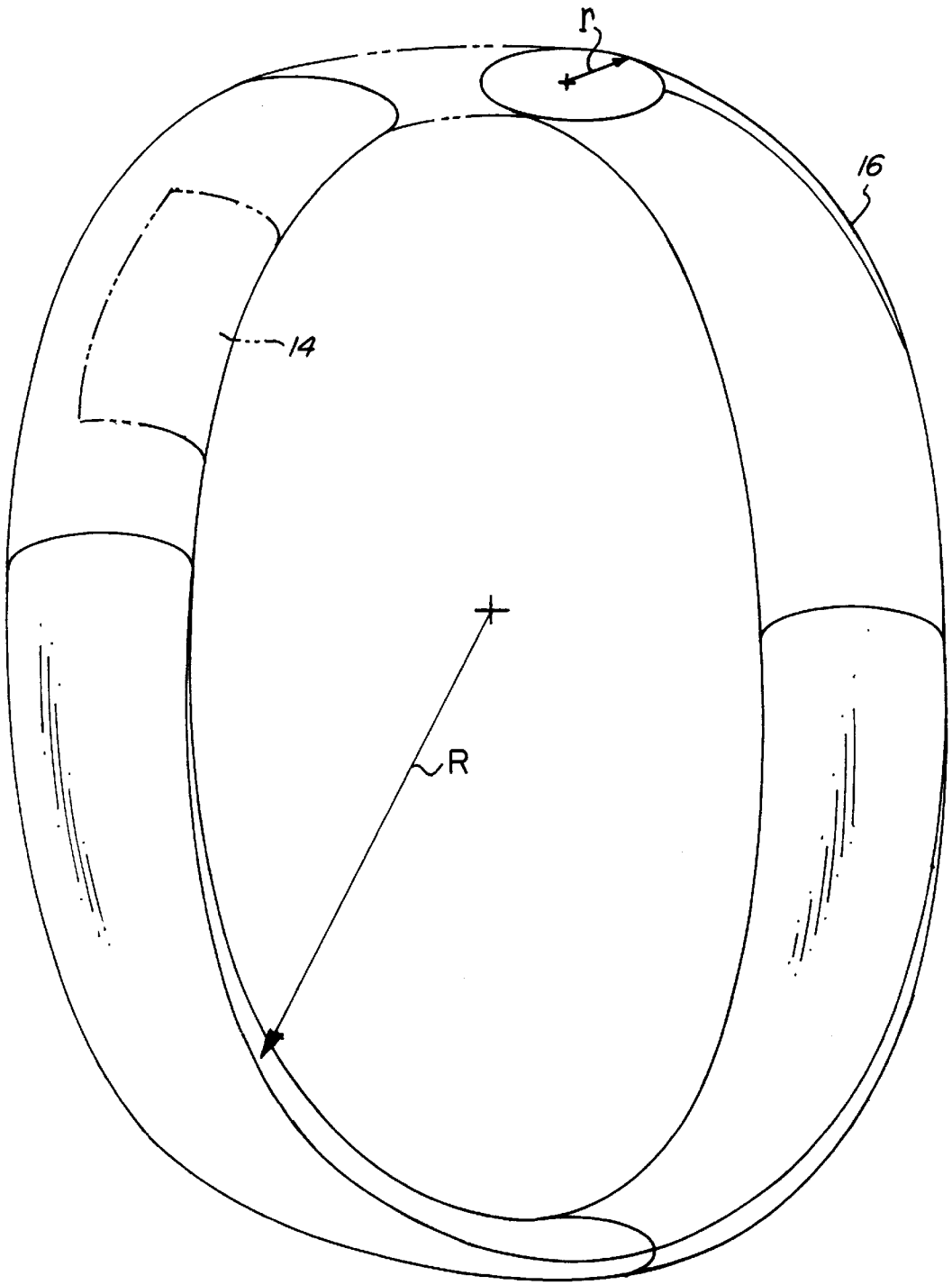
FIG. 3 is a side isometric view of a torus having a constant radius and an elliptical cross-section with the geometry of the molding surface of the concave mold of FIG. 1 shown in phantom, and a portion of the torus cut away to highlight the elliptical cross-section.
Figure 4:
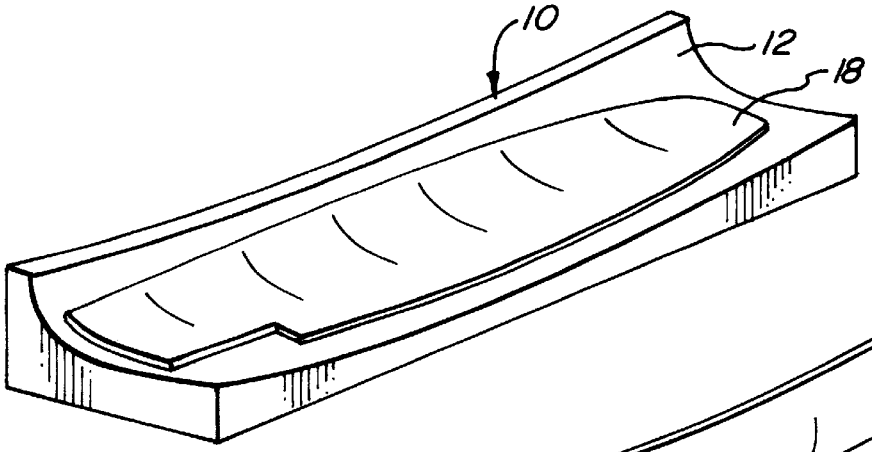
FIG. 4 is a side isometric view of the concave mold of FIG. 1 with a hull half panel contoured on the molding surface of the concave mold.
Figure 5:
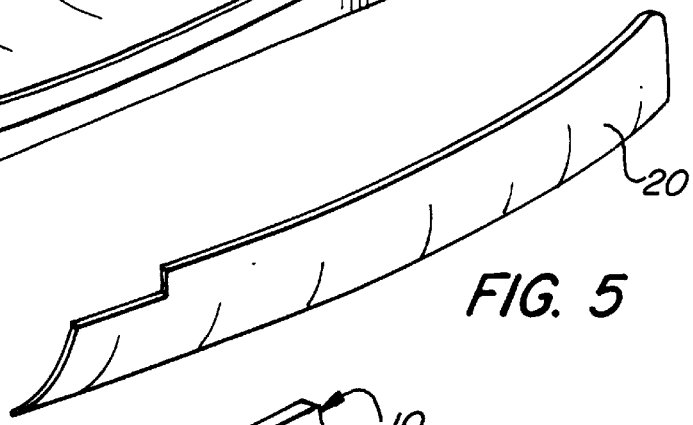
FIG. 5 is a side isometric view of the hull half panel of FIG. 4 removed from the concave mold.
Figure 6:
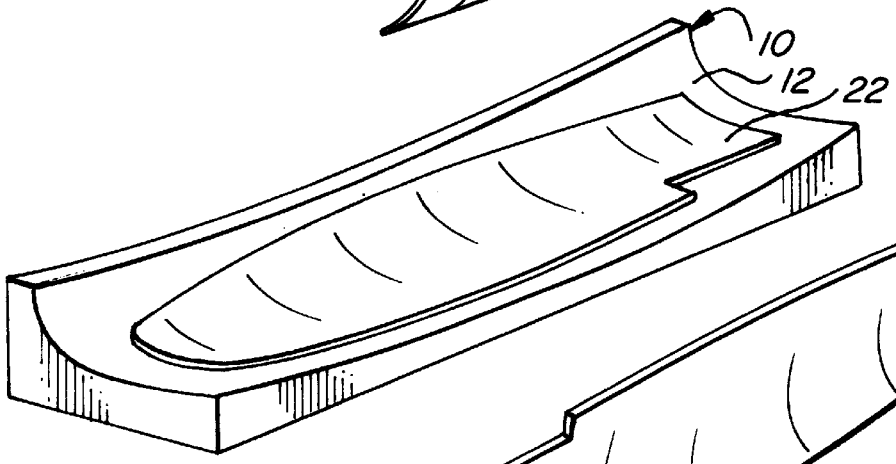
FIG. 6 is a side isometric view of the concave mold of FIG. 1 with a hull half panel, complementary to the hull half panel of FIGS. 4 and 5, contoured on the molding surface of the concave mold.
Figure 7:
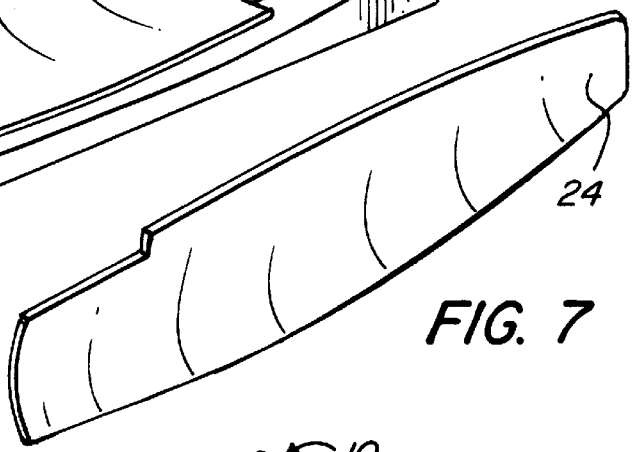
FIG. 7 is a side isometric view of the hull half panel of FIG. 6 removed from the concave mold.

Referring first to FIGS. 1 through 3, a concave mold 10 for use with the method of fabricating boat hulls in accordance with the present invention is shown. The concave mold 10 includes a compound molding surface 12. By compound, it is meant that molding surface 12 is curved along both its longitudinal and transverse axes, with both centers of curvature being located on the same side of the surface. The shape of molding surface 12 geometrically corresponds to a portion 14 of the surface of a torus 16 having a constant major radius of curvature R and an elliptical cross-section. By elliptical, it is meant that the minor radius of curvature r of torus 16 is not constant. Thus, molding surface 12 of concave mold 10 can be described as a compound surface having a constant longitudinal radius of curvature and a non-constant transverse radius of curvature.

Referring now to FIGS. 4 through 7, to fabricate a hull a first piece of molding material 18 is contoured on molding surface 12 of concave mold 10 in a particular position dependent on predetermined desired hull parameters. The first piece of molding material 18 is allowed to set and is removed from concave mold 10 as first hull half panel 20. A second piece of molding material 22 is then contoured on molding surface 12 of concave mold 10 in substantially the reverse profile of the first piece of molding material 18. After the second piece of molding material 22 is allowed to set, it is removed from the concave mold 10 as second hull half panel 24, which is a substantially mirrored image of first hull half panel 20. Finally, first hull half panel 20 and second hull half panel 24 are bonded together to form a boat hull.

The shape of molding surface 12 of concave mold 10 allows for producing hulls with various hydrostatic and hydrodynamic characteristics from a single mold. The molding material can be canted, or skewed, to produce hull panels with countless shapes, corresponding to the desired parameters of the hull. For example, if a finer bow is desired, the bow portion of the molding material can be skewed towards the flatter portion of molding surface 12. For a fuller aft, the aft section of the molding material could be skewed toward the section of molding surface 12 having the greater radius of curvature. If the designer desires a finer hull overall, the entire piece of molding material could be shifted to the flatter portion. As can be seen, any of an infinite number of possibilities is practicable.

Molding surface 12 of concave mold 10 is fair and airtight, thus allowing for the employment of vacuum molding, which makes practicable the use of high modulus fabrics and core materials, the use of a cored fiberglass material being preferred. Such cored composites produce a boat which is stronger and lighter than boats using traditional materials. Moreover, the use of vacuum molding allows panels to be fabricated having a much tighter radius than can be achieved using known veneer molding techniques. Furthermore, the use of a fair female mold produces hull panels with fair and paint-ready exterior surfaces. Thus, the lengthy and bothersome task of fairing the hull is not necessary. In addition, the molding material is laid in from above, allowing gravity to act as an aid in conforming the molding material to the shape of molding surface 12 of concave mold 10. This reduces the time required for material lay-up and aids in quality control.

Further enhancing the practicability of using stiff cored laminates is the fact that torturing of the hull half panels is not necessary due to their mirror imaged nature. Since the panels will fit together precisely right off the mold, no contortion is required when bonding the hull half panels together. Thus, inflexible materials can be used, providing greater hull strength, and making unnecessary the use of reinforcing interior frames, beams or stringers. The result is a boat having a living space which is larger and more comfortable.

The absence of the need to torture the hull half panels also enhances the modeling of hulls with various parameters. To create an accurate scale model of a hull, all that is required is a scale model of the mold. This was not the case when attempting to produce models of hulls produced with known molding techniques. If the hull half panels are tortured during bonding, each hull produced from the same mold will vary slightly, as will a model hull produced from a model mold. Moreover, if torturing is required to produce varying parameters, such as a finer bow, there is no accurate way to reproduce on the model hull the amount of torturing performed on the full sized hull. Since the full sized panels produced on the mold herein disclosed will not require torturing, a model hull built from panels produced on a model mold will be accurate.

Such accurate modeling is important for several reasons. As discussed above, the method for producing boat hulls herein disclosed lends itself to producing hulls with various parameters from a single mold. Accurate scale models will give a designer the hydrostatic and hydrodynamic information necessary to confirm design ideas and calculations through tank testing. This conformation is useful when attempting to modify the hull parameters to compensate for variables such as weight distribution of engines and cargo, and desired performance of the craft.

Figure 8:
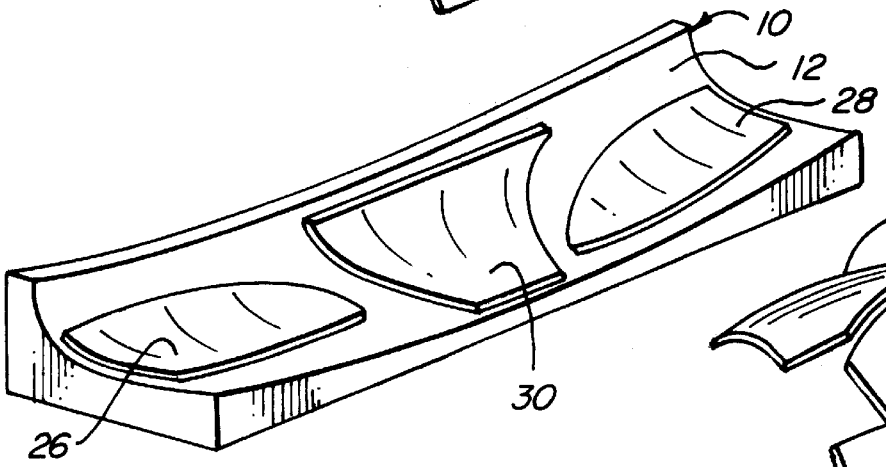
FIG. 8 is a side isometric view of the concave mold of FIG. 1 with cabin panels contoured on the molding surface of the concave mold.
Figure 9:
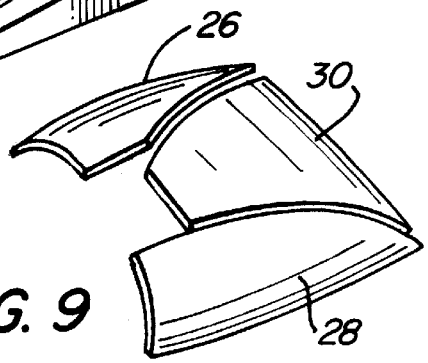
FIG. 9 is a side isometric view of the cabin panels of FIG. 8 removed from the concave mold; and, FIG. 10 is a top isometric exploded view of a catamaran fabricated from panels produced on the concave mold of FIG. 1.
Figure 10:
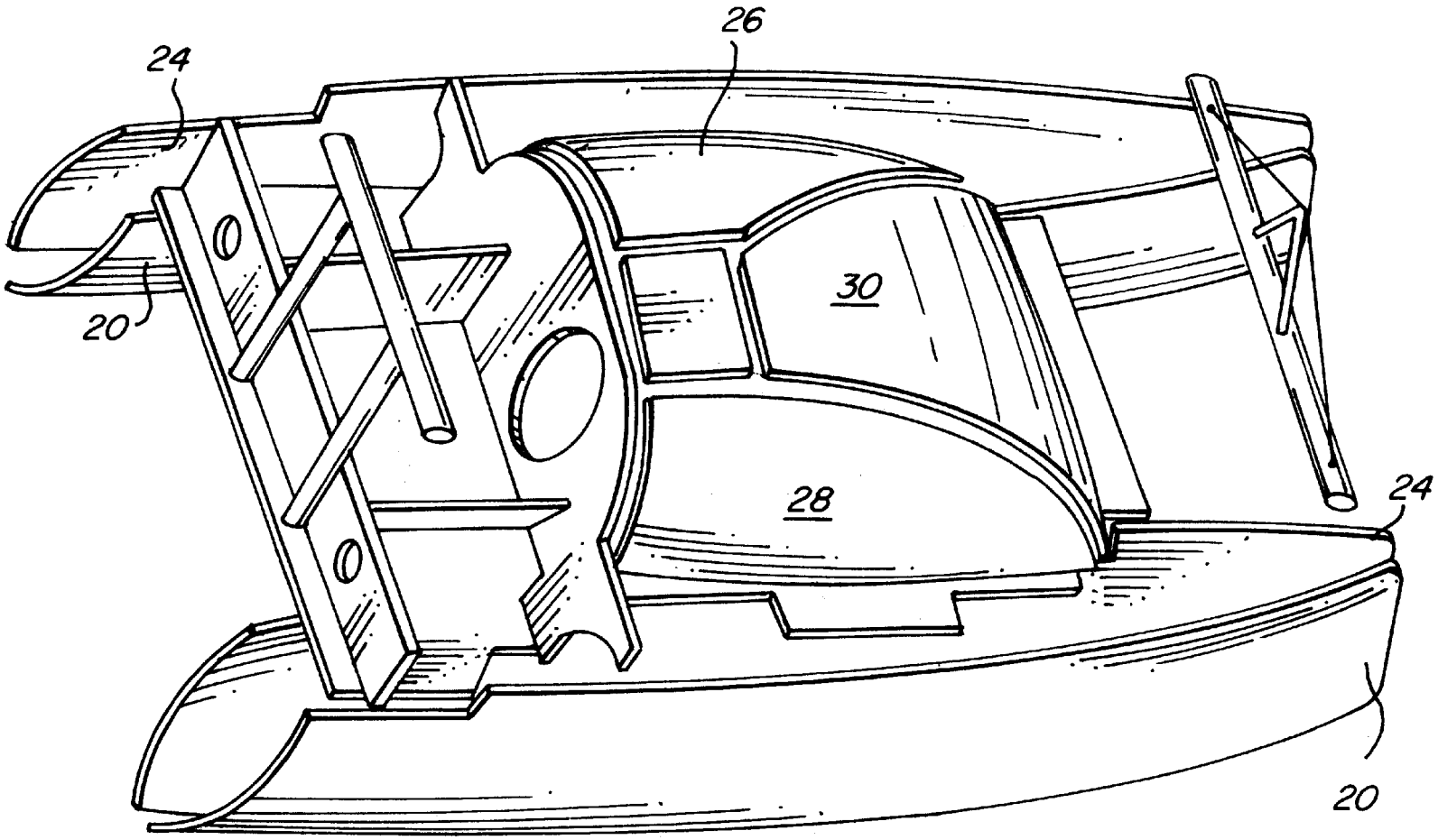

In addition to producing hull panels, concave mold 10 may also be used to produce various other components of a boat. FIGS. 8 and 9 illustrate how concave mold 10 may be used to produce starboard cabin panel 26, port cabin panel 28, and aft cabin panel 30. Producing these panels from concave mold 10 is desirable, as the fewer the molds required to produce the boat, the less the overall cost of fabrication. FIG. 10 shows an exploded view of a catamaran wherein all major structural elements of the boat are produced either on concave mold 10 or on a flat mold, thereby reducing the number of molds required to produce the entire craft to two.

The present invention, therefore, provides a method for producing molded panels for fabricating boat hulls by which shapes having a tight radius can be produced, by which the panels have finished and fair outer surfaces, by which torturing of the panels is not necessary to fabricate hulls having varying parameters, by which panels can be produced from very stiff materials, and by which accurate models of the finished boat hull can be easily created.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A method of fabricating a boat hull comprising the steps of:

molding a pair of hull half panels on a concave mold, the concave mold having a compound surface comprising a portion of the surface of a torus having a constant radius and an elliptical cross-section; and, bonding the pair of hull half panels together to form a boat hull.

2. The method of fabricating a boat hull of claim 1 wherein said molding step comprises molding each of the pair of hull half panels from a single piece of cored composite material.

3. The method of fabricating a boat hull of claim 1 wherein said molding step comprises molding each of the pair of hull half panels is substantially a mirror image of the other.

4. The method of fabricating a boat hull of claim 1 further comprising the steps of:

molding a second pair of hull half panels on the concave mold, the second pair of hull half panels having parameters differing from parameters of the first pair of hull half panels; and, bonding the second pair of hull half panels together to form a second boat hull having parameters differing form parameters of the first boat hull.

5. The method of fabricating a boat hull of claim 4 wherein said molding step comprises molding each of the second pair of hull half panels is substantially a mirror image of the other.

6. A method of fabricating a boat hull comprising the steps of:

providing a concave mold having a compound surface comprising a portion of the surface of a torus having a constant radius and an elliptical cross-section;

determining desired hull parameters of the boat hull;

contouring a first piece of molding material on the concave mold in a particular position dependent on the desired hull parameters to form a first hull half panel;

allowing the first piece of molding material to set;

removing the first hull half panel from the concave mold;

contouring a second piece of molding material on the concave mold in substantially the reverse profile of the first piece of molding material to form a second hull half panel, the second hull half panel comprising a substantially mirrored image of the first hull half panel;

allowing the second piece of molding material to set;

removing the second hull half panel from the concave mold; and, bonding the first hull half panel and the second hull half panel together to form a boat hull.

7. The method of fabricating a boat hull of claim 6 further comprising the steps of:

determining desired hull parameters of a second boat hull, the desired parameters of the second boat hull differing from the desired parameters of the first boat hull, contouring a third piece of molding material on the concave mold in a particular position dependent on the desired hull parameters of the second boat hull to form a third hull half panel;

allowing the third piece of molding material to set;

removing the third hull half panel from the concave mold;

contouring a fourth piece of molding material on the concave mold in substantially the reverse profile of the third piece of molding material to form a fourth hull half panel, the fourth hull half panel comprising a substantially mirrored image of the third hull half panel;

allowing the fourth piece of molding material to set;

removing the fourth hull half panel from the concave mold; and, bonding the third hull half panel and the fourth hull half panel together to form a second boat hull, the parameters of the second boat hull differing from the parameters of the first boat hull.

8. A concave mold for producing panels for use in fabricating boat hulls comprising a compound molding surface which comprises a portion of the surface of a torus having a constant radius and an elliptical cross-section, said molding surface being adapted to produce hull half panels having shapes corresponding to any of a plurality of hydrostatic and hydrodynamic parameters.

9. The concave mold of claim 8 wherein said molding surface is further adapted be capable of producing two hull half panels in the mirrored image of each other.

10. The concave mold of claim 8 wherein said molding surface is further adapted to produce hull half panels having finished outer surfaces such that the surfaces are paint-ready without fairing.

* * * * *